US009500037B2

(12) United States Patent
Carlstrom et al.

(10) Patent No.: US 9,500,037 B2
(45) Date of Patent: Nov. 22, 2016

(54) DRILL BIT FOR PERCUSSIVE ROCK DRILLING

(75) Inventors: Bo Carlstrom, Sandviken (SE); Jens Sundin, Sandviken (SE); Susanne Lejon, Sandviken (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 731 days.

(21) Appl. No.: 13/643,693

(22) PCT Filed: Feb. 11, 2011

(86) PCT No.: PCT/SE2011/050153
§ 371 (c)(1),
(2), (4) Date: Apr. 15, 2013

(87) PCT Pub. No.: WO2011/136714
PCT Pub. Date: Nov. 3, 2011

(65) Prior Publication Data

US 2013/0213718 A1 Aug. 22, 2013

(30) Foreign Application Priority Data

Apr. 29, 2010 (EP) ..... 10161383

(51) Int. Cl.
*E21B 17/042* (2006.01)
*E21B 10/36* (2006.01)

(52) U.S. Cl.
CPC ..... *E21B 10/36* (2013.01); *E21B 17/0426* (2013.01)

(58) Field of Classification Search
CPC ..... E21B 1/00; E21B 10/36; E21B 10/38; E21B 17/042
USPC ..... 175/414
See application file for complete search history.

(56) References Cited

U.S. PATENT DOCUMENTS

| | | | | |
|---|---|---|---|---|
| 1,477,855 | A * | 12/1923 | Thurston | E21B 17/00 175/320 |
| 1,733,392 | A | 10/1929 | Barra | |
| 3,258,077 | A | 6/1966 | Phipps | |
| 3,258,284 | A | 6/1966 | Phipps | |
| 4,540,200 | A * | 9/1985 | Larsson | 285/332.4 |
| 2002/0074797 | A1 | 6/2002 | Liljebrand | |
| 2004/0050592 | A1 * | 3/2004 | Carlstrom et al. | 175/414 |
| 2006/0060388 | A1 * | 3/2006 | Linden et al. | 175/414 |
| 2008/0304904 | A1 | 12/2008 | Olsson et al. | |

FOREIGN PATENT DOCUMENTS

| | | | |
|---|---|---|---|
| JP | 08151885 | A | 6/1996 |
| JP | 2006241836 | A | 9/2006 |
| JP | 2006241837 | A | 9/2006 |
| RU | 2297512 | C2 | 4/2007 |
| WO | 0019056 | A1 | 4/2000 |
| WO | 0138685 | A1 | 5/2001 |

* cited by examiner

*Primary Examiner* — Giovanna C Wright
(74) *Attorney, Agent, or Firm* — Corinne R. Gorski

(57) ABSTRACT

The invention relates to a drill bit (20) for percussive rock drilling, which comprises: —a drill head (21); —a skirt (24), which has a first end and an opposite second end, the skirt being connected to the drill head at said first end; —a recess (25) extending axially through the skirt from the second end of the skirt towards the first end thereof, the recess being provided with an internal, cylindrical female thread (26); and —an impact surface (27) at the bottom of the recess. Every cross-section of the recess (25) between the impact surface and the part of the recess where the female thread has its full thread profile has a cross-sectional area which is smaller than the cross-sectional area of a cross-section of the recess at the part of the recess where the female thread has its full thread profile.

14 Claims, 3 Drawing Sheets

DRILL BIT FOR PERCUSSIVE ROCK DRILLING

RELATED APPLICATION DATA

This application is a §371 National Stage Application of PCT International Application No. PCT/SE2011/050153 filed Feb. 11, 2011 claiming priority of European Application No. 10161383.4, filed Apr. 29, 2010.

FIELD OF THE INVENTION AND PRIOR ART

The present invention relates to a drill bit for percussive rock drilling.

A previously known drill bit for percussive rock drilling is illustrated in FIG. 1. A drill bit of this type is for instance disclosed in WO 2004/003334 A1 (and US 2002/074797, US 2008/304904 or WO 01/38685). This known drill bit 1 comprises:

a drill head 2;

a skirt 3;

a recess 4 extending axially through the skirt 3 from the rear end of the skirt towards the drill head 2, the recess being provided with an internal female thread 5 for connection to a corresponding external male thread 6 of a drill rod 7 and; and an impact surface 8 for abutment against an end surface 9 of a drill rod, this impact surface 8 being formed at the bottom of the recess 4 and extending perpendicularly to the longitudinal axis of the drill bit.

The part of the recess 4 between the inner end of the female thread 5 and the impact surface 8 is wider than the female thread so as to provide a thread clearance 10 at the inner end of the female thread.

Each of U.S. Pat. No. 3,258,077A and U.S. Pat. No. 3,258,284 A discloses a drill bit having a shoulder abutment. JP 8 151885 A, on which the preamble of claim 1 is based, discloses a drill bit with locally increased diameter of the drill bit in the vicinity of the impact surface.

SUMMARY OF THE INVENTION

The object of the present invention is to achieve a further development of a drill bit of the above-mentioned type so as to provide a drill bit which is improved in at least some aspects.

According to the invention, this object is achieved by a drill bit having the features defined in claim 1.

The drill bit of the present invention comprises:

a drill head;

a skirt, which has a first end and an opposite second end, the skirt being connected to the drill head at said first end;

a recess extending axially through the skirt from the second end of the skirt towards the first end thereof, the recess being provided with an internal, cylindrical female thread for connection to a corresponding external, cylindrical male thread of a drill rod; and an impact surface for abutment against an end surface of a drill rod, this impact surface being formed at the bottom of the recess and extending perpendicularly to the longitudinal axis of the drill bit. According to the invention, every cross-section of the recess between the impact surface and the part of the recess where the female thread has its full thread profile has a cross-sectional area which is smaller than the cross-sectional area of a cross-section of the recess at the part of the recess where the female thread has its full thread profile. Thus, the drill bit of the present invention lacks a widened thread clearance between the inner end of the female thread and the impact surface. Such a thread clearance will give a reduced thickness of the skirt wall in the part of the skirt wall surrounding the thread clearance as compared to the part of the skirt wall surrounding the female thread. Such a part of the skirt wall with reduced wall thickness, and consequently reduced cross-sectional area of the skirt wall, will constitute a weakened part or fracture zone FZ (see FIG. 1) at the drill bit. The present invention is based on the realization that the strength of the drill bit can be improved by dispensing with a thread clearance between the inner end of the female thread and the impact surface. The strength improvement has been measured to 18% for a drill bit according to the present invention as compared to a corresponding drill bit according the above-mentioned prior art. Without such a thread clearance, the recess of the drill bit can be formed in such a manner that every cross-section of the recess between the impact surface and the part of the recess where the female thread has its full thread profile has a cross-sectional area which is smaller than the cross-sectional area of a cross-section of the recess at the part of the recess where the female thread has its full thread profile. Hereby, no point of reduced strength is introduced in the part of the skirt extending between the impact surface and the female thread.

In this description and the subsequent claims, the expression "cross-section of the recess" refers to a section across the recess perpendicularly to the longitudinal axis of the drill bit.

Further advantages as well as advantageous features of the drill bit according to the invention will appear from the following description and the dependent claims.

BRIEF DESCRIPTION OF THE DRAWING

With reference to the appended drawing, a specific description of preferred embodiments of the invention cited as examples follows below. In the drawings.

DETAILED DESCRIPTION OF PREFERRED EMBODIMENTS OF THE INVENTION

Figure 1:
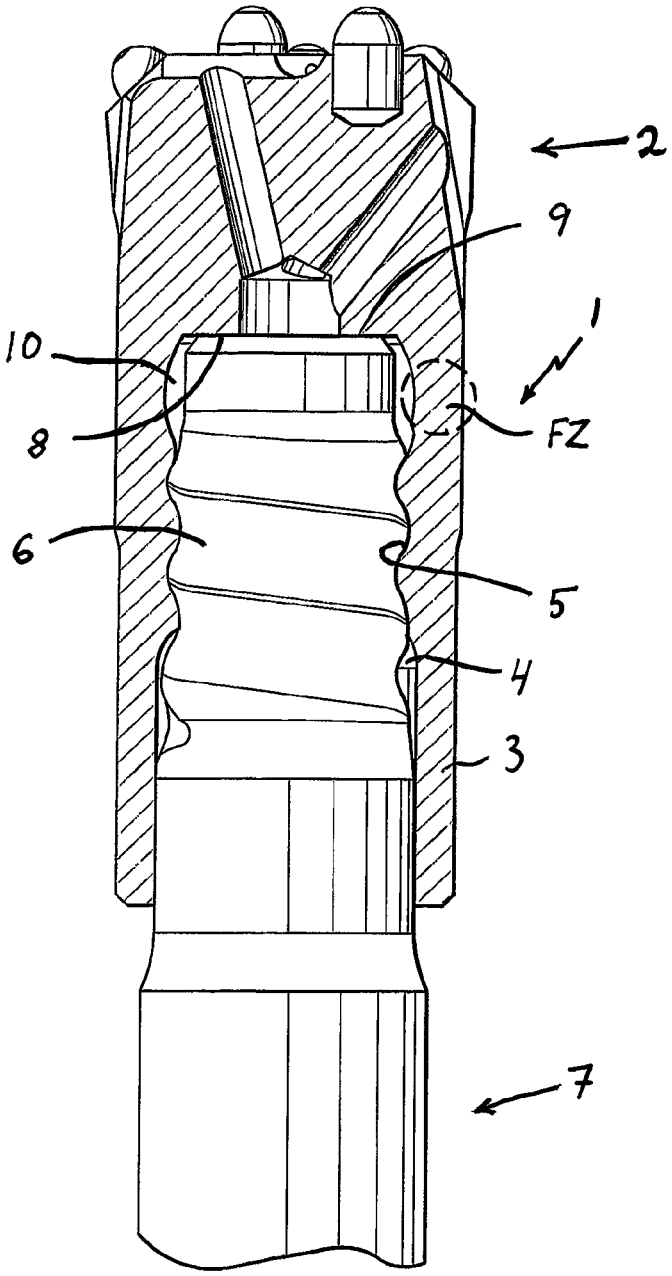
Fig 1 PRIOR ART
FIG. 1 is a partly cut lateral view of a drill bit according to prior art connected to a drill rod.
Figure 2:
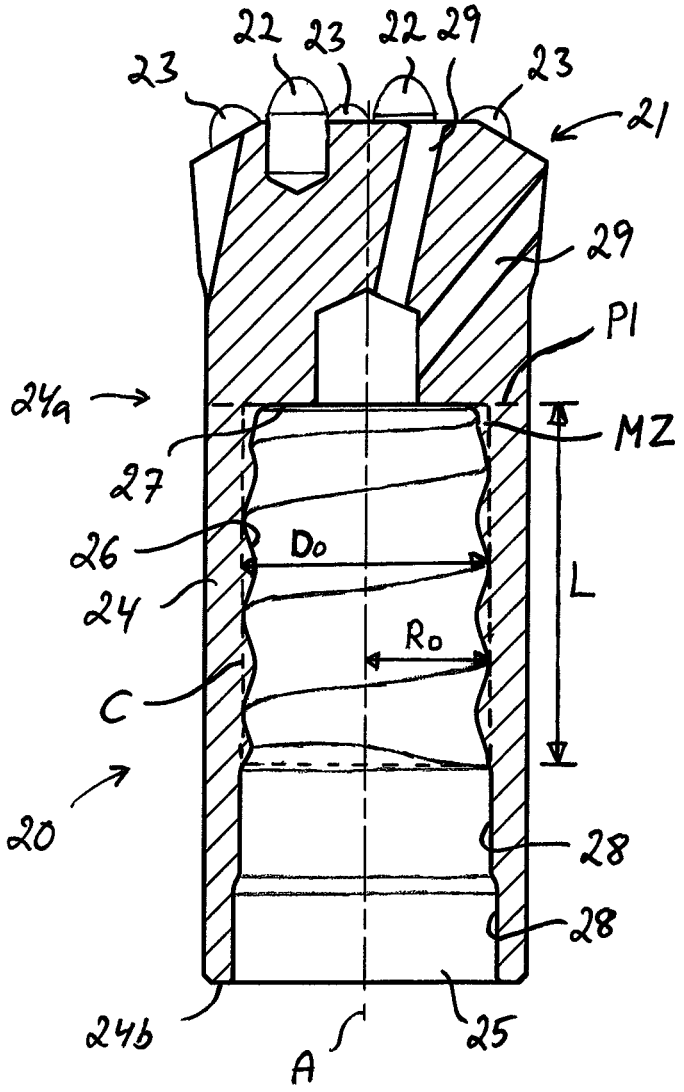
FIG. 2 is a partly cut lateral view of a drill bit according to an embodiment of the present invention.
Figure 3:
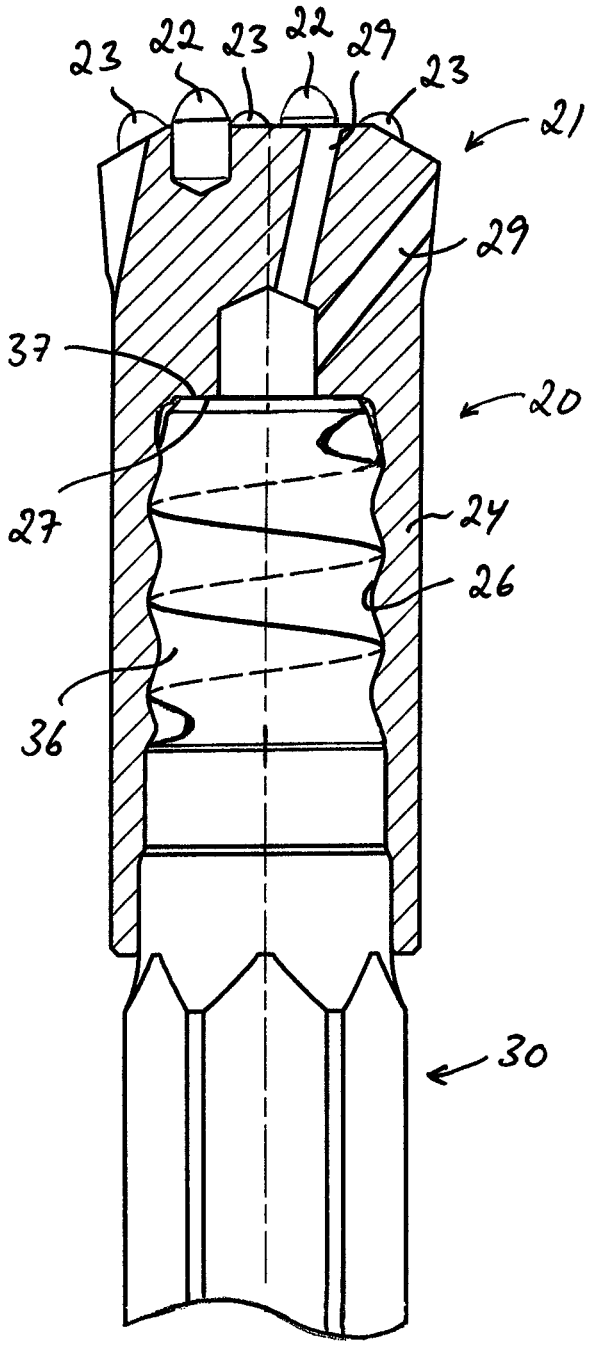
FIG. 3 is a partly cut lateral view of the drill bit according to FIG. 2 connected to a drill rod.

A drill bit 20 for percussive rock drilling according to an embodiment of the present invention is illustrated in FIGS. 2 and 3. This drill bit 20 comprises a drill head 21, which is provided with rock cutting members 22, 23 at its front end. In the illustrated embodiment, the rock cutting members are constituted by cemented carbide inserts in the form of front buttons 22 and peripheral buttons 23. At its rear end, the drill head 21 is connected to a skirt 24. The drill head 21 and the skirt 24 are formed in one piece of a suitable metallic material, such as for instance steel.

The skirt 24 has a first end 24*a*, through which the skirt is connected to the drill head 21, and an opposite second end 24*b*. A recess 25 extends axially through the skirt 24 from the second end 24*b* of the skirt towards the first end 24*a* thereof. This recess 25 is provided with an internal, cylindrical female thread 26 for connection to a corresponding external, cylindrical male thread 36 provided at an end of a drill rod 30. The female and male threads may be of any conventional thread form, such as rope threads or trapezoidal threads. The thread form shown in the figures is a rope thread. An impact surface 27 for abutment against an end surface 37 of a drill rod 30 is formed at the bottom of the recess 25. This impact surface 27 extends perpendicularly to the longitudinal axis A of the drill bit 20. The recess 25 is suitably provided with one or more unthreaded cylindrical surfaces 28 between the outer end of the female rope thread 26 and the second end 24*b* of the skirt 24, as illustrated in FIGS. 2 and 3. The recess 25 is in fluid communication with the front end of the drill head 21 through a number of flush channels 29 extending through the drill head. When the drill bit 20 is connected to a drill rod 30 with the female thread 26 of the drill bit in engagement with the male thread 36 of the drill rod and with the impact surface 27 of the drill bit in abutment against the end surface 37 of the drill rod (as illustrated in FIG. 3), the flush channels 29 of the drill bit are in fluid communication with a flush channel (not shown) which extends axially through the drill rod along the centre axis thereof.

Every cross-section of the recess 25 along the part of the recess where the thread 26 has its full thread profile has one and the same cross-sectional area. The expression "full thread profile" can be defined as the profile which is present along a majority of the entire thread length.

No thread clearance is provided in the recess 25 between the inner end of the female thread 26 and the impact surface 27, and every cross-section of the recess 25 between the impact surface 27 and the part of the recess where the female thread 26 has its full thread profile has a cross-sectional area which is smaller than the cross-sectional area of a cross-section of the recess 25 at said part of the recess where the female thread 26 has its full thread profile.

The recess 25 has its smallest cross-sectional area at its bottom and the impact surface 27 defines the smallest radial cross-sectional area of the recess 25. Thus, the area of the impact surface 27 is smaller than the cross-sectional area of any cross-section of the recess 25 between the impact surface 27 and the second end 24*b* of the skirt 24.

It can also be seen in FIG. 2 that the cross-sectional area of the recess 25 is gradually reduced from the inner end of the female thread 26 to the impact surface 27. The radial cross-sectional area of the recess 25 continuously increases along the recess from the impact surface 27 all the way on to the part of the recess where the female thread 26 has its full thread profile. The axial distance between the impact surface 27 and the inner end of the part of the recess where the female thread 26 has its full thread profile is preferably 8-12 mm, which implies that the part of the recess where the female thread 26 has its full thread profile begins 8-12 mm from the impact surface 27 as seen in the axial direction.

The radial distance Ro from the longitudinal axis A of the drill bit 20 to the deepest point of the thread bottom of the female thread 26, i.e. the largest radius of the female thread, is preferably equal to or smaller than 18.5 mm at the part of the recess where the female thread has its full thread profile.

Preferably, the female thread 26 has 2.8-3.2 thread turns with full thread profile.

An imaginary cylinder C is illustrated in broken lines in FIG. 2. This imaginary cylinder C has such a diameter Do that its envelope surface touches the deepest point of the thread bottom of the female thread along the part of the recess where the female thread 26 has its full thread profile. Thus, $Do=2\cdot Ro$.

The diameter Do of said imaginary cylinder C is preferably equal to or smaller than 37 mm, while fulfilling the following condition:

$$1.3 \leq L/Do \leq 1.6$$

where L is the axial distance from the impact surface 27 to the outer end of the part of the recess where the female thread 26 has its full thread profile.

An annular material zone MZ is formed between a cross-sectional plane P1 extending through the impact surface 27 and the envelope surface of the above-mentioned imaginary cylinder C. The annular material zone MZ forms an area at a certain axial cross-section that tapers towards where the female thread has its full thread profile.

The drill bit 20 is to be used for percussive rock drilling with the drill bit 20 connected to a top hammer device through one or more drill rods 30.

With the drill bit 20 according to the present invention, it will be possible to provide a longer female thread 26, and thereby a longer contact surface between the female thread 26 of the drill bit 20 and the corresponding male thread 36 of the drill rod 30, as compared to a drill bit according to the above-mentioned prior art, without increasing the axial distance L from the impact surface 27 to the outer end of the part of the recess where the female thread 26 has its full thread profile. Furthermore, there will be better possibilities to alter the space for cuttings removal while maintaining the skirt sufficiently strong, or to increase the strength of the skirt 24, due to the fact that the wall of the skirt 24 can be designed without having to take into account any fracture zone at the inner end of the skirt. The presently claimed drill bit i.a. solves the problem of weak skirts, i.e. by increasing the wall thickness without affecting the outside of the drill bit.

It should be noted that the female thread 26 of the drill bit according to the present invention is a cylindrical thread and not the type of conical thread used in drill pipes or drill tubes for rotary oil drilling.

The invention is of course not in any way restricted to the embodiment described above. On the contrary, many possibilities to modifications thereof will be apparent to a person with ordinary skill in the art without departing from the basic idea of the invention such as defined in the appended claims.

The disclosures in European patent application No. 10161383.4, from which this application claims priority, are incorporated herein by reference.

The invention claimed is:

1. A drill bit for percussive rock drilling comprising:

a drill head;

a skirt having a first end and an opposite second end, the skirt being connected to the drill head at said first end;

a recess extending axially through the skirt from the second end of the skirt towards the first end thereof, the recess being provided with an internal, cylindrical female thread for connection to a corresponding external, cylindrical male thread of a drill rod; and an impact surface for abutment against an end surface of a drill rod, said impact surface being formed at the bottom of the recess and extending perpendicularly to a longitudinal axis of the drill bit, wherein no thread clearance is provided in the recess between an inner end of the female thread and the impact surface and every cross-section of the recess between the impact surface and the part of the recess where the female thread has a full thread profile has a cross-sectional area which is smaller than the cross-sectional area of a cross-section of the recess at the part of the recess where the female thread has a full thread profile.

2. A drill bit according to claim 1, wherein the impact surface defines the smallest radial cross-sectional area of the recess.

3. A drill bit according to claim 1, wherein the radial cross-sectional area of the recess continuously increases along the recess from the impact surface all the way on to the part of the recess where the female thread has a full thread profile.

4. A drill bit according to claim 1, wherein an annular material zone is formed between a cross-sectional plane containing the impact surface and an envelope surface of an imaginary cylinder which has such a diameter that the envelope surface touches the deepest point of the thread bottom of the female thread along the part of the recess where the female thread has a full thread profile.

5. A drill bit according to claim 4, wherein the diameter of said imaginary cylinder equal to or smaller than 37 mm, while fulfilling the following condition:

$$1.3<L/Do<1.6$$

where Do is the diameter of the imaginary cylinder and L is the axial distance from the impact surface to the outer end of the part of the recess where the female thread has a full thread profile.

6. A drill bit according to claim 5, wherein the axial distance between the impact surface and the inner end of the part of the recess where the female thread has a full thread profile is 8 to 12 mm.

7. A drill bit according to claim 1, wherein a radial distance from the longitudinal axis of the drill bit to a deepest point of the thread bottom of the female thread is equal to or smaller than 18.5 mm at the part of the recess where the female thread has its full thread profile.

8. A drill bit according to claim 1, wherein the number of thread turns with full thread profile of the female thread is 2.8 to 3.2.

9. A drill bit according to claim 1, wherein the recess is provided with at least one unthreaded cylindrical surface between the female thread and said second end of the skirt.

10. A drill bit according to claim 1, wherein rock cutting members in the form of front buttons and peripheral buttons are provided at the front end of the drill head.

11. A drill bit according to claim 1, wherein the recess is in fluid communication with the front end of the drill head through one or more flush channels extending through the drill head.

12. A drill bit according to claim 1, wherein the female thread is a rope thread.

13. A drill bit according to claim 1, wherein the drill bit is connected to a top hammer device for percussive rock drilling through one or more drill rods.

14. A drill bit according claim 1, wherein the female thread is a trapezoidal thread.

* * * * *